US008789262B2

(12) United States Patent
Liu

(10) Patent No.: US 8,789,262 B2
(45) Date of Patent: Jul. 29, 2014

(54) METHOD FOR MAKING SURFACE MOUNT INDUCTOR

(75) Inventor: Chien Chih Liu, Hsinchu (TW)

(73) Assignee: Mag. Layers Scientific Technics Co., Ltd., Hsinchu Industrial Park Hukou, Hsinchu (TW)

( * ) Notice: Subject to any disclaimer, the term of this patent is extended or adjusted under 35 U.S.C. 154(b) by 132 days.

(21) Appl. No.: 13/449,526

(22) Filed: Apr. 18, 2012

(65) Prior Publication Data

US 2013/0276298 A1 Oct. 24, 2013

(51) Int. Cl.
*H01F 7/06* (2006.01)

(52) U.S. Cl.
USPC ..... 29/606; 29/592.1; 29/602.1; 29/605; 336/110; 336/175; 336/178; 336/184; 336/214; 363/17; 363/48; 363/58

(58) Field of Classification Search
USPC ..... 29/602.1, 604, 606, 607; 336/110, 175, 336/178, 184, 214, 215, 234; 363/17, 48, 363/58
See application file for complete search history.

(56) References Cited

U.S. PATENT DOCUMENTS

| | | | | |
|---|---|---|---|---|
| 5,751,203 | A | 5/1998 | Tsutsumi et al. | |
| 6,154,112 | A | 11/2000 | Aoba et al. | |
| 6,577,218 | B2 * | 6/2003 | Hamatani et al. | 336/83 |
| 6,614,338 | B2 * | 9/2003 | Hamatani et al. | 336/83 |
| 6,661,328 | B2 * | 12/2003 | Inoue et al. | 336/233 |
| 6,825,746 | B2 * | 11/2004 | Otsuka et al. | 336/83 |
| 7,015,783 | B2 * | 3/2006 | Nakata et al. | 336/83 |
| 7,042,324 | B2 | 5/2006 | Watanabe | |
| 7,525,405 | B2 * | 4/2009 | La Valle et al. | 336/83 |

* cited by examiner

*Primary Examiner* — Paul D Kim
(74) *Attorney, Agent, or Firm* — Charles E. Baxley

(57) ABSTRACT

A method for manufacturing an inductor includes a mold device having a mold cavity, disposing a coil member above the mold cavity of the mold device, filling metallic particles into the mold cavity of the mold device, forcing the coil member into the metallic particles to form a base member, applying two conductive coating members onto the base member and electrically connecting to the terminals of the coil member respectively, and attaching two conductive coverings onto the conductive coating members respectively and electrically connecting to the conductive coating members respectively for allowing the inductors to be quickly manufactured in a mass production.

10 Claims, 4 Drawing Sheets

METHOD FOR MAKING SURFACE MOUNT INDUCTOR

BACKGROUND OF THE INVENTION

1. Field of the Invention

The present invention relates to an inductor making or manufacturing method or procedure, and more particularly to a method for suitably and easily and quickly making or manufacturing one or more inductors with reduced manufacturing procedures and processes and for precisely making or manufacturing the inductors, and for reducing the manufacturing cost for the inductors and for reducing the defective rate for the inductors.

2. Description of the Prior Art

Typical inductors have been developed and provided for inducing the current and comprise one or more cores and one or more coils or conductive members wound or attached or mounted or engaged onto and around the core for inducing or generating the current.

For example, U.S. Pat. No. 5,751,203 to Tsutsumi et al. discloses one of the typical inductors also comprising one or more coils or conductive members engaged into a drum-shaped core for inducing or generating the current, and a cylindrical core disposed around the drum-shaped core and the coil, and a terminal table attached or mounted or engaged onto the drum-shaped core and the coil and the cylindrical core.

The typical inductors include a coil having two ends are drawn through a gap that is formed between the terminal table and the drum-shaped core and the coil and the cylindrical core for coupling or connecting to winding terminals. However, the ends of the coil may not be easily and quickly and readily attached or mounted or secured onto the surfaces of the electric circuit boards or the like with working machines, and should be mounted manually such that the specialized or trained workers may take a long time to mount the typical inductors manually. In addition, a complicated making or manufacturing method or procedure is required to make or manufacture the coils such that the manufacturing cost for the coils will be greatly increased.

U.S. Pat. No. 6,154,112 to Aoba et al. discloses another typical chip inductor comprising a coil or winding attached or mounted or engaged onto the winding core and disposed or located between end flanges.

Normally, the coil or winding includes a longitudinal and cylindrical structure that may occupy a large volume for the typical chip inductor, and the ends of the coil or winding should be hammered or squeezed before the ends of the coil or winding can be attached or mounted or secured onto the surfaces of the electric circuit boards or the like, and the typical chip inductor should be mounted onto the surfaces of the electric circuit boards or the like manually by specialized or trained workers. In addition, a complicated making or manufacturing method or procedure is required to make or manufacture the coils such that the manufacturing cost for the coils will be greatly increased.

U.S. Pat. No. 7,042,324 to Watanabe discloses a further typical surface mount inductor comprising a coil or winding attached or mounted or engaged onto or wound around a winding shaft section of the drum core, and the winding wire of the typical surface mount inductor also includes a circular cross section, and the terminals of the winding wire are then wound from the outside of the extended portions of the case body and also wound onto the binding terminals.

However, the winding wire that includes a circular cross section may also occupy a large volume, and the terminals of the winding wire also includes a circular cross section and may not be easily and quickly and readily attached or mounted or secured onto the surfaces of the electric circuit boards or the like with working machines, and should be mounted manually such that the specialized or trained workers may take a long time to mount the typical inductors manually. In addition, a complicated making or manufacturing method or procedure is required to make or manufacture the coils such that the manufacturing cost for the coils will be greatly increased.

The present invention has arisen to mitigate and/or obviate the afore-described disadvantages of the conventional inductive members or inductors manufacturing methods.

SUMMARY OF THE INVENTION

The primary objective of the present invention is to provide a method for suitably and easily and quickly making or manufacturing one or more inductors with reduced manufacturing procedures and processes and for precisely making or manufacturing the inductors, and for reducing the manufacturing cost for the inductors and for reducing the defective rate for the inductors.

In accordance with one aspect of the invention, there is provided a method for making or manufacturing one or more inductors comprising preparing a mold device having a mold cavity formed therein, preparing and disposing and locating a coil member above the mold cavity of the mold device, filling metallic particles into the mold cavity of the mold device, forcing the coil member into the metallic particles to form a base member having the coil member engaged in the base member, the coil member including two terminals, applying two conductive coating members onto the base member and electrically connecting to the terminals of the coil member respectively, and attaching two conductive coverings onto the conductive coating members respectively and electrically connecting to the conductive coating members respectively to form the final product of the inductors.

A heating process may further be provided for heating the metallic particles to harden the metallic particles and to form the base member. A removing process may further be provided for removing the base member from the mold device after the coil member is forced into the metallic particles to form the base member.

A heating process may further be provided for heating the conductive coating members before the conductive coverings are attached onto the conductive coating members respectively. A filling process may further be provided for filling additional metallic particles into the mold cavity of the mold device after the coil member is forced into the metallic particles to form the base member.

The mold device includes a first mold piece having a chamber formed therein, and a second mold piece received and engaged in the chamber of the first mold piece for forming the mold cavity in the first mold piece and above the second mold piece, the second mold piece is slidable and movable relative to the first mold piece to increase a volume of the mold cavity in the first mold piece and for filling additional metallic particles into the mold cavity of the mold device after the coil member is forced into the metallic particles to form the base member.

A preparing process may further be provided for preparing and disposing and locating a support device above the mold device for engaging with the coil member and for supporting the coil member above the mold device. The support device includes a frame member having two side fences, the coil member includes two end portions coupled to the side fences of the frame member. The end portions of the coil member are cut when the coil member is forced into the metallic particles with a plunger.

The base member includes a parallelepiped shape defined by two opposite end portions, two opposite side portions, a bottom portion, and an upper portion, the terminals of the coil member are directed toward the opposite end portions of the base member and flush with the opposite end portions of the base member respectively.

The conductive coating members each include an outer peripheral flange attached onto the bottom portion and the upper portion and the opposite side portions of the base member. The conductive coverings each include an outer peripheral flange attached onto the outer peripheral flange of the conductive coating member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
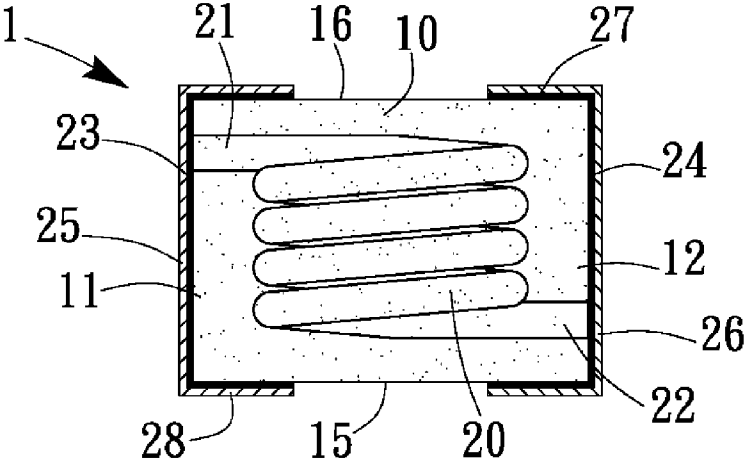
FIG. 1 is a cross sectional view of an inductor to be made or manufactured with a method in accordance with the present invention.
Figure 10:
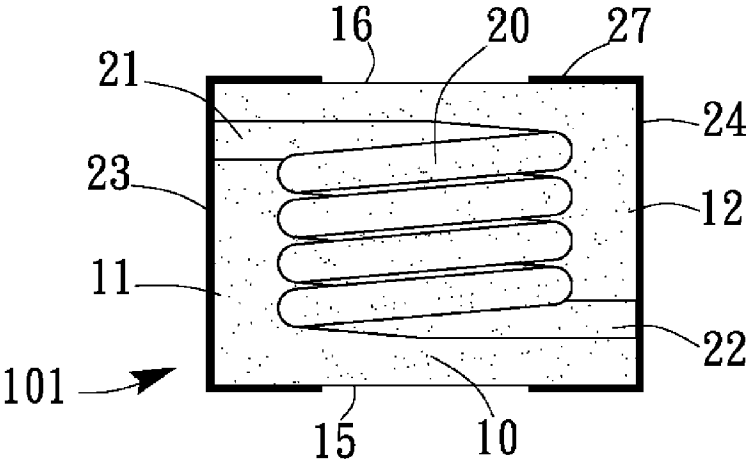
FIG. 10 is a cross sectional view similar to FIG. 1, illustrating the other making or manufacturing procedures or processes for the inductors.
Figure 9:
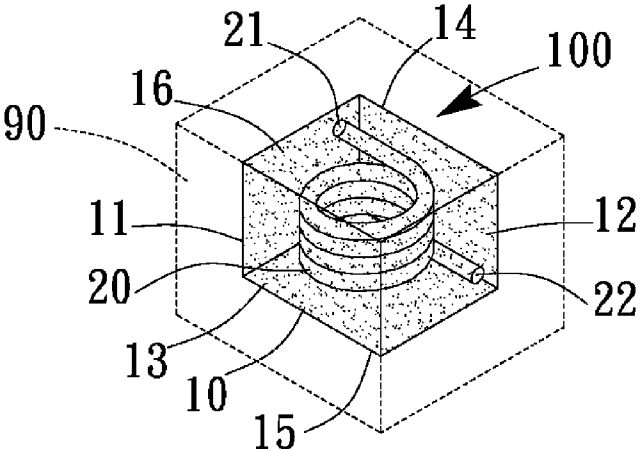
FIG. 9 is a perspective view illustrating a prototype of the inductor.

Referring to the drawings, and initially to FIGS. 1 and 9-10, an inductor 1 to be made or manufactured with a method in accordance with the present invention comprises a primary body or core or base member 10 including a substantially parallelepiped shape or structure having two opposite end walls or surfaces or portions 11, 12, two opposite side walls or surfaces or portions 13, 14, a bottom wall or surface or portion 15, and an upper wall or surface or portion 16, in which FIGS. 9 and 10 illustrates the prototypes 100, 101 of the inductor 1, and FIG. 1 illustrates a final product of the inductor 1. The core or base member 10 is made or formed by a metallic material which includes or is composed of or is made of a number of iron or ferrite powders or particles, in which the iron or ferrite powders or particles include a diameter preferably ranging from 0.1~500 μm.

The inductor 1 further includes a conductive device or coil member 20 disposed or fitted or embedded or engaged into the base member 10, and the coil member 20 includes two terminals 21, 22 extended or provided or directed toward the two opposite end portions 11, 12 of the base member 10, and preferably flush with the opposite end portions 11, 12 of the base member 10 respectively. It is preferable, but not necessarily that the coil member 20 and/or the terminals 21, 22 of the coil member 20 includes a circular or elliptical or olivary cross section or the like. The inductor 1 further includes two conductive coating members 23, 24 disposed or attached or mounted or secured or coated or printed or painted or applied onto the two opposite end portions 11, 12 of the base member 10 respectively and electrically contacted and connected or coupled to the terminals 21, 22 of the coil member 20 respectively (FIGS. 1, 10).

As shown in FIG. 1, the inductor 1 further includes two conductive and electroplated coverings 25, 26 also disposed or attached or mounted or secured or coated or printed or painted or applied onto the two opposite end portions 11, 12 of the base member 10 respectively and electrically connected or coupled to the conductive coating members 23, 24 respectively, such that the terminals 21, 22 of the coil member 20 are also electrically connected or coupled to the conductive and electroplated coverings 25, 26 respectively, in which the conductive and electroplated coverings 25, 26 may be made of the materials selected from copper, brass, nickel, tin, or silver, or the like, and may be printed or painted or applied or electroplated onto the two opposite end portions 11, 12 of the base member 10 respectively. The conductive coating members 23, 24 may be made of the conductive resin materials and may also be printed or painted or applied or electroplated onto the two terminals 21, 22 of the coil member 20 respectively.

The conductive coating members 23, 24 may further include an outer peripheral portion or skirt or flange 27 (FIGS. 1, 10) attached or mounted or secured or coated or printed or painted or applied onto the bottom portion 15 and/or the upper portion 16 and/or the two opposite side portions 13, 14 of the base member 10 for allowing the conductive coating members 23, 24 to be solidly and stably anchored or secured or retained to the base member 10. The conductive and electroplated coverings 25, 26 may further include an outer peripheral portion or skirt or flange 28 (FIG. 1) attached or mounted or secured or coated or printed or painted or applied onto the bottom portion 15 and/or the upper portion 16 and/or the two opposite side portions 13, 14 of the base member 10, or onto the outer peripheral portion or skirt or flange 27 of the conductive coating members 23, 24 respectively, for allowing the conductive and electroplated coverings 25, 26 to be solidly and stably anchored or secured or retained to the conductive coating members 23, 24 respectively.

Figure 2:
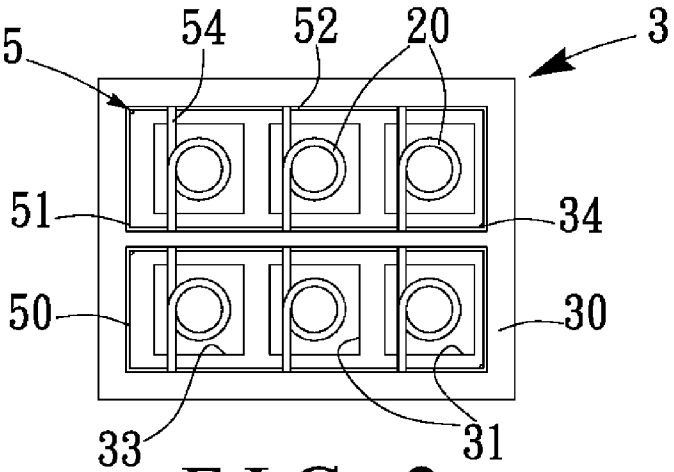
FIG. 2 is a top plan schematic view illustrating a mold device for making or manufacturing the inductors.
Figure 3:
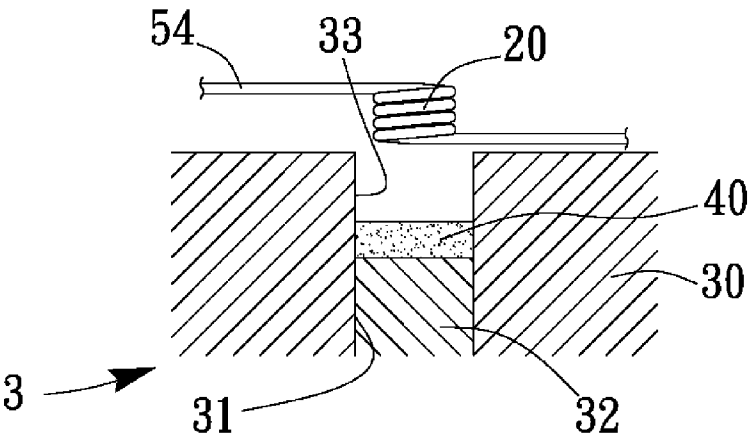
FIG. 3 is a partial cross sectional view of the mold device illustrating the making or manufacturing procedures or processes for the inductors.

Referring next to FIGS. 2 and 3, a mold device 3 is further prepared or provided for operating or conducting the making or manufacturing procedures or processes for the inductors 1, and includes a base or primary or first mold piece 30 having one or more chambers 31 formed therein, and one or more auxiliary or movable or second mold pieces 32 slidably received or engaged in the chambers 31 of the primary or first mold piece 30 respectively, and slidable or movable relative to the primary or first mold piece 30, for forming or defining a mold cavity 33 in the upper portion of each of the chambers 31 of the primary or first mold piece 30, or above the respective auxiliary or second mold piece 32. For example, the auxiliary or second mold pieces 32 may be slid or moved downwardly (FIG. 5) or upwardly (FIG. 8) relative to the primary or first mold piece 30; or the primary or first mold piece 30 may be slid or moved downwardly (FIG. 8) or upwardly (FIG. 5) relative to the auxiliary or second mold pieces 32 for determining or adjusting the mold cavity 33 of the mold device 3 into different sizes or scales or volumes or dimensions.

As shown in FIG. 2, a frame or support device 5 is further provided and includes one or more frame members 50, 51 located above and disposed or attached or mounted on top of the mold device 3, and accurately or precisely anchored or retained or positioned on the mold device 3, in the process 70 (FIG. 13) with one or more projections or alignment pins 34 (FIG. 2) that are extended upwardly away from the mold device 3, the frame members 50, 51 each include two side fences 52 that are preferably, but not necessarily parallel to each other. A number of coil members 20 (FIGS. 2-4, 13) are each provided and prepared and formed and wound or formed from a longitudinal wire material, and each include two end portions 54 attached or mounted or secured or coupled to the side fences 52 of the frame members 50, 51 with adhesive materials, by welding processes, or the like, for allowing the coil members 20 to be attached or mounted or supported or straddled between the side fences 52 of the frame members 50, 51, the coil members 20 are disposed or located or arranged above and aligned with the respective mold cavities 33 or the auxiliary or second mold pieces 32 of the mold device 3, the end portions 54 of the coil members 20 are longer than the terminals 21, 22 of the coil member 20.

Figure 4:
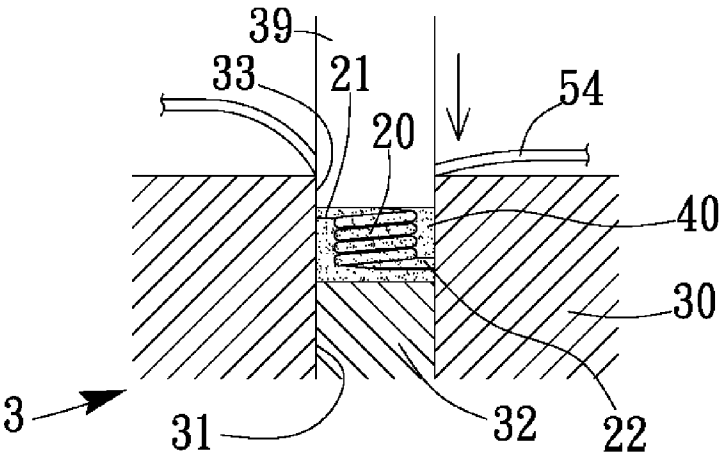
FIGS. 4, 5, 6, 7, 8 are partial cross sectional views similar to FIG. 3, illustrating the further making or manufacturing procedures or processes for the inductors.
Figure 5:
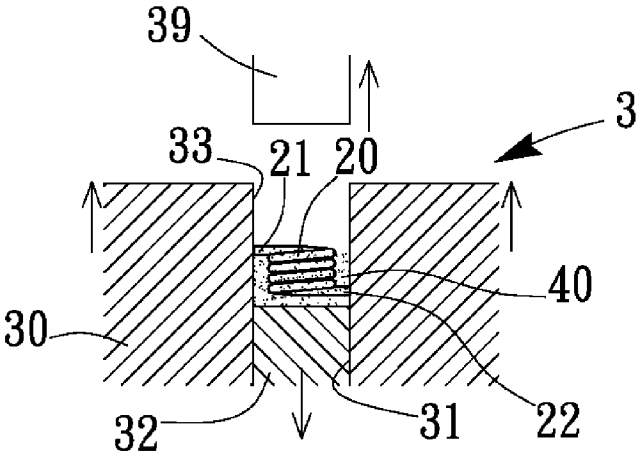

When making or manufacturing the inductors 1, as shown in FIG. 3, the metallic or iron or ferrite powders or particles 40 are disposed or filled into the mold cavities 33 of the mold device 3 and located below the coil members 20 respectively. As shown in FIG. 4, a number of mold elements or hammers or ejectors or plungers 39 are then moved downwardly to engage with the coil members 20 and to cut the end portions 54 of the coil members 20 in the cutting process 71 (FIG. 13), with a punching or hammering or engaging force ranging from 0.1 to 1.0 ton, and to force and to engage the coil members 20 into the metallic particles 40 respectively, and thus to form the terminals 21, 22 of the coil member 20. As shown in FIG. 5, the plunger 39 is then moved upwardly away from the mold device 3 and the metallic particles 40 and the coil member 20, and the auxiliary or second mold piece 32 may be optionally slid or moved downwardly relative to the primary or first mold piece 30; or alternatively, the primary or first mold piece 30 may be optionally slid or moved upwardly relative to the auxiliary or second mold piece 32 in the moving process 72 (FIG. 13) for increasing the size or scale or volume or dimension the mold cavities 33 of the mold device 3.

Figure 6:
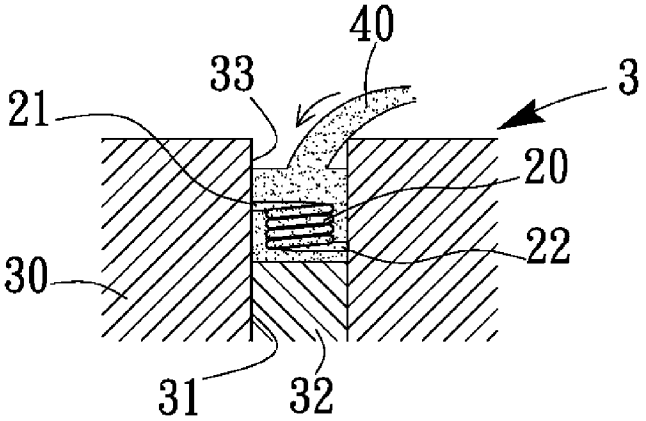
Figure 7:
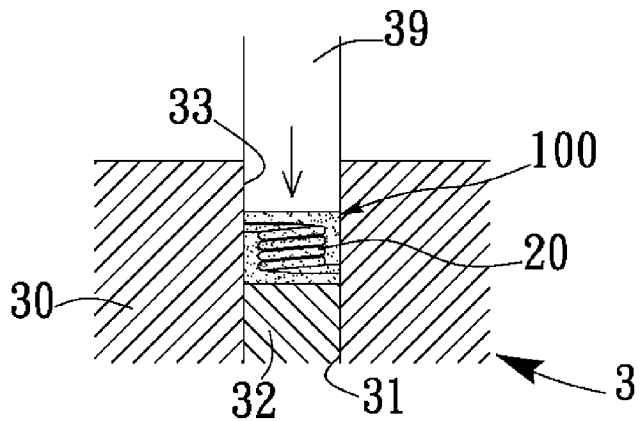
Figure 8:
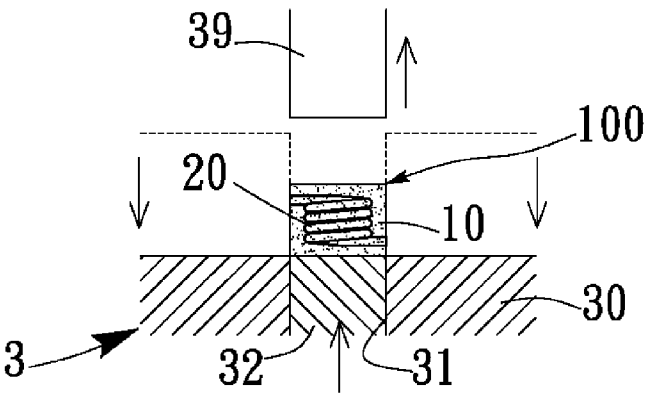

As shown in FIG. 6, the further metallic particles 40 may then be disposed or filled into the enlarged mold cavities 33 of the mold device 3 in the filling process 73 (FIG. 13), and the plungers 39 may then be moved downwardly again (FIG. 7) to engage with the further metallic particles 40 and to suitably embed or engage the coil member 20 within the metallic particles 40, and for hammering or squeezing or punching or forging or forcing the metallic particles 40 into the base member 10 in the punching or forging or forcing process 74 (FIG. 13), and thus for hammering or squeezing or forming the metallic particles 40 and the coil member 20 into the prototype 100 as shown in FIGS. 7-9. As shown in FIG. 8, the plunger 39 may then be moved upwardly away from the mold device 3 again, and the auxiliary or second mold piece 32 may be optionally slid or moved upwardly relative to the primary or first mold piece 30, and/or the primary or first mold piece 30 may be optionally slid or moved downwardly relative to the auxiliary or second mold piece 32 for moving and exposing and removing the prototype 100 from the mold device 3 in the removing process 75 (FIG. 13).

Figure 12:
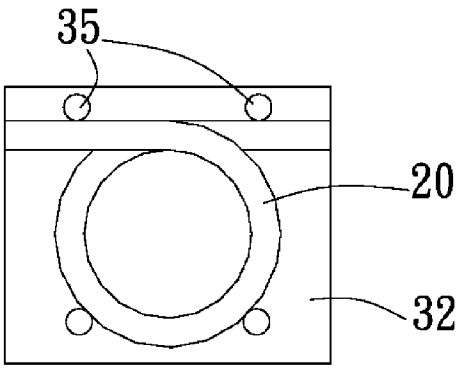
FIG. 12 is a partial top plan schematic view of the mold device as shown in FIG. 11, illustrating the making or manufacturing procedures or processes for the inductors.
Figure 11:
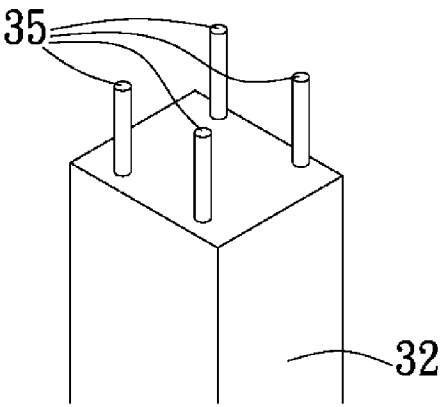
FIG. 11 is a partial perspective view illustrating a portion of the mold device for making or manufacturing the inductors.

As shown in FIGS. 11 and 12, the auxiliary or second mold pieces 32 each may further include one or more (such as four) poles 35 slidably received or engaged therein and optionally or selectively extendible out the respective auxiliary or second mold piece 32 for optionally or selectively engaging with the coil member 20 and for anchoring or securing or retaining or positioning or aligning or organizing the coil member 20 on the respective auxiliary or second mold piece 32, and the poles 35 may be optionally slid or moved or engaged into the respective auxiliary or second mold piece 32 by the plunger 39, for example. The prototype 100 is then disposed or engaged into the furnace or oven 90 (FIG. 9) and heated to a temperature ranging from 140 to 200° C., for about four (4) to ten (10) hours, in order to solidify or harden and to form the metallic particles 40 into the base member 10 in the first heating process 76 (FIG. 13).

Figure 13:
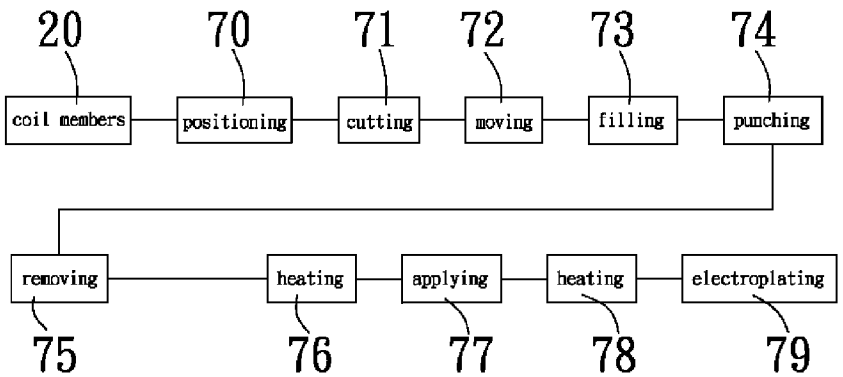
FIG. 13 is a block diagram illustrating the making or manufacturing procedures or processes for the inductors.

As shown in FIG. 10, the conductive coating members 23, 24 are then disposed or attached or mounted or secured or coated or printed or painted or applied onto the two opposite end portions 11, 12 of the base member 10 respectively in the applying process 77 (FIG. 13) in order to form the prototype 101 of the inductor 1, and the prototype 101 is then disposed or engaged into the furnace or oven 90 (FIG. 9) again and heated to a temperature ranging from 200 to 260° C., for about thirty (30) to forty (40) minutes, in order to solidify or to harden the conductive coating members 23, 24, and so as to solidly and stably anchor or secure or retain the conductive coating members 23, 24 on the two opposite end portions 11, 12 of the base member 10 respectively in the second heating process 78 (FIG. 13). The heated prototype 101 is then electroplated with the conductive coverings 25, 26 with an electroplating machine (not shown) or the like in the electroplating process 79 (FIG. 13) in order to form the final product 1 as shown in FIG. 1.

It is to be noted that the inductors 1 may be easily and quickly and readily made or manufactured with the mold device 3 and the support device 5 in a mass production, and the terminals 21, 22 of the coil member 20 and the conductive coverings 25, 26 of the inductor 1 may then be easily and quickly attached or mounted or secured onto the surfaces of the electric circuit boards (not shown) with working machines, or surface mount device (SMD) (not shown) in a mass production. It is further to be noted that the coil member 20 may be directly and suitably and quickly punched or hammered or engaged into the metallic particles 40 with the plunger 39 or the like in a single process without refilling the metallic particles 40 into the mold cavity 33 of the mold device 3.

Figure 15:
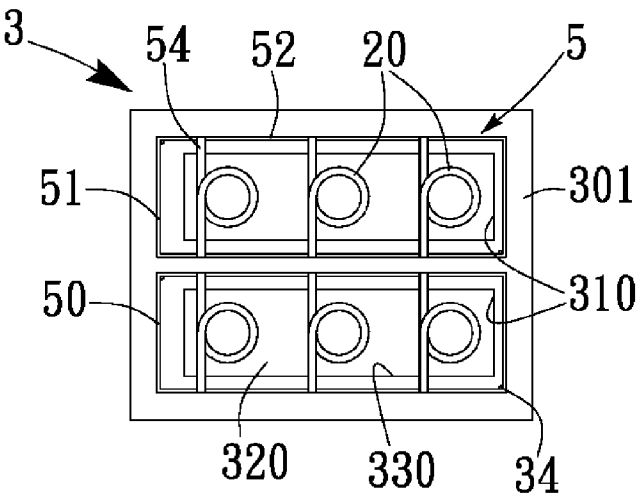
FIG. 15 is a top plan schematic view similar to FIG. 2, illustrating the other arrangement of the mold device for making or manufacturing the inductors.
Figure 14:
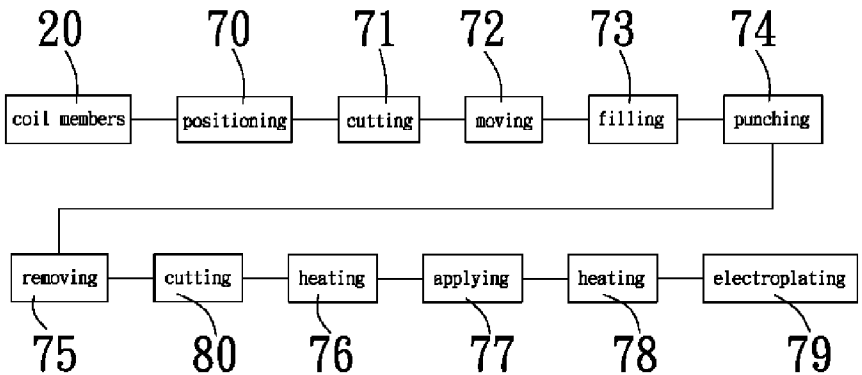
FIG. 14 is another block diagram similar to FIG. 13, illustrating the other making or manufacturing procedures or processes for the inductors.

Alternatively, as shown in FIGS. 14 and 15, the chambers 310 and/or the mold cavities 330 of the primary or first mold piece 301 of the mold device 3 may be formed into different sizes or scales or volumes or dimensions for slidably receiving or engaging with the auxiliary or second mold pieces 320 of different sizes or scales or volumes or dimensions, and include a size or scale or volume or dimension equal to two or more prototypes 100, and the greater prototypes are then required to be cut into the separated prototypes 100 in the further cutting process 80 (FIG. 14), such that the primary or first mold piece 301 and the auxiliary or second mold pieces 320 of the mold device 3 may also be used to easily and quickly make or manufacture the inductors with reduced manufacturing procedures and processes.

Accordingly, the method in accordance with the present invention may be provided for suitably and easily and quickly making or manufacturing one or more inductors with reduced manufacturing procedures and processes and for precisely making or manufacturing the inductors, and for reducing the defective rate for the inductors.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A method for manufacturing an inductor comprising:

preparing a mold device having a mold cavity formed therein;

preparing and disposing and locating a coil member above said mold cavity of said mold device;

filling metallic particles into said mold cavity of said mold device;

forcing said coil member into said metallic particles to form a base member, in which said coil member is engaged in said base member, said coil member including two terminals;

applying two conductive coating members onto said base member and electrically connecting to said terminals of said coil member respectively;

attaching two conductive coverings onto said conductive coating members respectively and electrically connecting to said conductive coating members respectively; and preparing and disposing and locating a support device above said mold device for engaging with said coil member and for supporting said coil member above said mold device, and said support device including a frame member having two side fences, said coil member including two end portions coupled to said side fences of said frame member.

2. The method as claimed in claim 1 further comprising a heating process for heating said metallic particles to harden said metallic particles and to form said base member.

3. The method as claimed in claim 1 further comprising a removing process for removing said base member from said mold device after said coil member is forced into said metallic particles to form said base member.

4. The method as claimed in claim 1 further comprising a heating process for heating said conductive coating members before said conductive coverings are attached onto said conductive coating members respectively.

5. The method as claimed in claim 1 further comprising a filling process for filling additional metallic particles into said mold cavity of said mold device after said coil member is forced into said metallic particles to form said base member.

6. The method as claimed in claim 5, wherein said mold device includes a first mold piece having a chamber formed therein, and a second mold piece received and engaged in said chamber of said first mold piece for forming said mold cavity in said first mold piece and above said second mold piece, said second mold piece is slidable and movable relative to said first mold piece to increase a volume of said mold cavity in said first mold piece and for filling additional metallic particles into said mold cavity of said mold device after said coil member is forced into said metallic particles to form said base member.

7. The method as claimed in claim 1, wherein said end portions of said coil member are cut when said coil member is forced into said metallic particles with a plunger.

8. The method as claimed in claim 1, wherein said base member includes a parallelepiped shape defined by two opposite end portions, two opposite side portions, a bottom portion, and an upper portion, said terminals of said coil member are directed toward the opposite end portions of the base member and flush with the opposite end portions of the base member respectively.

9. The method as claimed in claim 8, wherein said conductive coating members each include an outer peripheral flange attached onto the bottom portion and the upper portion and the opposite side portions of the base member.

10. The method as claimed in claim 9, wherein said conductive coverings each include an outer peripheral flange attached onto said outer peripheral flange of said conductive coating member.

* * * * *